US006257573B1

(12) United States Patent
Munoz et al.

(10) Patent No.: US 6,257,573 B1
(45) Date of Patent: Jul. 10, 2001

(54) DEVICE FOR SUPPLYING/RETAINING/ CHECKING BALLS FOR LABYRINTH-TYPE GAMES OF CHANCE

(75) Inventors: Joaquin Franco Munoz; Jesus Franco Munoz, both of Madrid (ES)

(73) Assignee: Proindumar, S.L., Madrid (ES)

( * ) Notice: Subject to any disclaimer, the term of this patent is extended or adjusted under 35 U.S.C. 154(b) by 0 days.

(21) Appl. No.: 09/274,400

(22) Filed: Mar. 23, 1999

(51) Int. Cl.[7] ..... A63F 7/02; A63F 7/34

(52) U.S. Cl. ..... 273/121 B; 273/121 E; 273/121 A; 273/120 R; 273/120 A; 273/122 R; 273/122 A; 273/138.1; 273/138.2

(58) Field of Search ..... 273/121 R, 121 A, 273/121 B, 121 D, 121 E, 120 R, 120 A, 122 R, 122 A, 124 R, 124 A, 125 R, 125 A, 138.2, 138.1

(56) References Cited

U.S. PATENT DOCUMENTS 5,016,879 * 5/1991 Parker et al. ..... 273/126 A 5,639,089 * 6/1997 Matumoto et al. ..... 273/142 E

* cited by examiner

*Primary Examiner*—Benjamin H. Layno
(74) *Attorney, Agent, or Firm*—Ostrolenk, Faber, Gerb & Soffen, LLP

(57) ABSTRACT

The board game (1), with the conventional pivots (2) determining the labyrinth-type course for the ball, is framed by a circumferential channel (5) in which there is a ring (8) provided with at least one lateral, internal opening (12) so that, upon the rotation of said ring (8) each housing (12) is placed, in sequence, opposite a lower opening (7) of the circumferential channel (5) in order to receive a ball (16) and opposite another upper opening (6) via which the ball returns, under gravity, to the game zone. In addition, in the passages (3) which the ball or balls (16) has or have to reach at the end of each play there are arms or stops (13) capable of closing off said passages, retaining the ball or balls (16) for a sufficient time for the player to be able to observe it or them and subsequently allowing it or them to fall, to which end said arms or stops (13), crossing the board (1) via transverse grooves (15), are fixed in a monobloc manner forming a type of comb (14) which can be actuated transversely by an electromagnet (17).

9 Claims, 5 Drawing Sheets

A-B

DEVICE FOR SUPPLYING/RETAINING/ CHECKING BALLS FOR LABYRINTH-TYPE GAMES OF CHANCE

SUBJECT OF THE INVENTION

The present invention relates to a device intended to form part of a labyrinth-type game of chance, such as those used in certain recreational machines, and more specifically to a device which is capable of supplying a plurality of balls to a game board, upon each play, and of retaining them in any of the exit passages, for reckoning up the possible prize either on the basis of the value given to each one of the passages or on the basis of the various combinations of passages, also allowing a complete view of the balls during their travel and also a complete view of which passages have been taken by said balls.

The device is especially suitable for use in recreational machines offering cash prizes, especially as a basis for a game to complement the principal game of this type of machine, based on rotating drums.

BACKGROUND OF THE INVENTION

Labyrinth-type games of chance have been known since time immemorial and are used in recreational machines which employ a game board, in a vertical arrangement, which defines, together with a transparent front cover, a planar housing in which there is a plurality of pivots which determine a random labyrinth-type path a ball which, gaining access to the game board via the upper zone of the board, falls under gravity between said pivots until it reaches any one of the multiple lower passages or exits which, on occasion, end in channels directed toward different points while others simply have respective scores which the player incorporates into his marker in some way.

Games of this type pose a set of problems involving, basically, the following aspects:

on occasion, the speed of fall of the ball, together with the latter's small dimensions, prevents the player having a completely clear view of which of the exit passages the ball has taken, giving rise to confused situations which may annoy the player if the latter believes that the machine has awarded him a score which is lower than the score corresponding to that passage which, in his opinion, has been taken by the ball;

the return of the ball, from its exit via the lower part of the board until its re-entry thereto via the top part, is concealed from the player who may thus be inclined to think that the ball is projected toward the game board in a specific direction which does not promote his obtaining a high score;

the mechanisms for raising the ball are located behind the game board, frequently occupying a space which is very large, in most cases greater than the thickness of the actual game board;

specific, practical embodiments of labyrinth-type games also pose particular or specific problems which, although they do not exist in other embodiments, substantially reduce the performance level of this type of machine.

DESCRIPTION OF THE INVENTION

The device proposed by the invention fully satisfactorily solves the set of problems set forth above in terms of the various aspects commented upon.

To this end, the body in which the game board is installed and, more specifically, the game surface, is framed at the front by a circumferential channel in which there is a close-fitting ring provided with one or more housings which are open toward its inner edge and capable of being placed opposite two communication windows between the game zone and said channel, obviously on the inner wall of the latter, at extreme upper and lower levels thereof, so that the ring can receive the ball or balls under gravity when its housing or housings passes or pass beneath the lower window and can give it or them up to the game board, also under gravity, when it passes over the upper window.

This ring is actuated by a gear motor suitably fastened to the rear face of the body.

in accordance with another of the characteristics of the invention, the transparent front plate which closes the game zone extends also to the circumferential channel so that the entire path of the ball is visible.

Conventional lugs determining the labyrinth-type course for the balls and small partitions determining the passages for the exit of the balls emerge from the game surface, but with the special feature that, corresponding to said passages and on the game surface, there are transverse grooves in which there are stops or arms associated with a common support, like a comb, which is actuated by an electromagnet so that, under normal conditions, said arms or stops of said retention comb block off the exit from the respective passages, immobilizing the ball or balls in any of them for a sufficiently long period for it or them to be in full view of the player, at the same time as its or their position is detected by the play circuit of the machine, with a view to delivering the corresponding prize, if appropriate, after which the electromagnet drags said retention comb, which is also transparent in nature, across as far as a limit situation in which its arms are located beneath the partitions, leaving the passages free and, consequently, allowing the ball or balls to fall so that it or they can be picked up again by the ring during its rotary movement.

As a means whereby the game circuit of the machine can detect the path of the ball, provision has been made for the use of sensor of the photoemitter/receiver type, with the special feature that said sensor are located behind the game board, completely protected and invisible, their lightbeam being interrupted, as the ball passes, by a rocking lever placed in each one of the passages and which crosses the game board via a vertical groove thereof so that the ball, as it passes, causes the corresponding lever to rock and act on the sensor.

In accordance with the aforesaid, the machanisms for both lifting and immobilizing the ball are, in practice, incorporated in the planar body which constitutes the game board, thereby presenting a smaller volume and, consequently, facilitating its installation in any type of machine, since the ball-pass sensors, located on its rear face, are small in size and have no appreciable effect on the overall volume of the assembly.

DESCRIPTION OF THE DRAWINGS

To supplement the description which is being given and with a view to assisting better understanding of the characteristics of the invention, in accordance with a preferred practical illustrative embodiment thereof, said description is accompanied, as an integral part thereof, by a set of drawings in which, in an illustrative and non-limiting way, the following have been represented.

PREFERRED EMBODIMENT OF THE INVENTION

Figure 1:
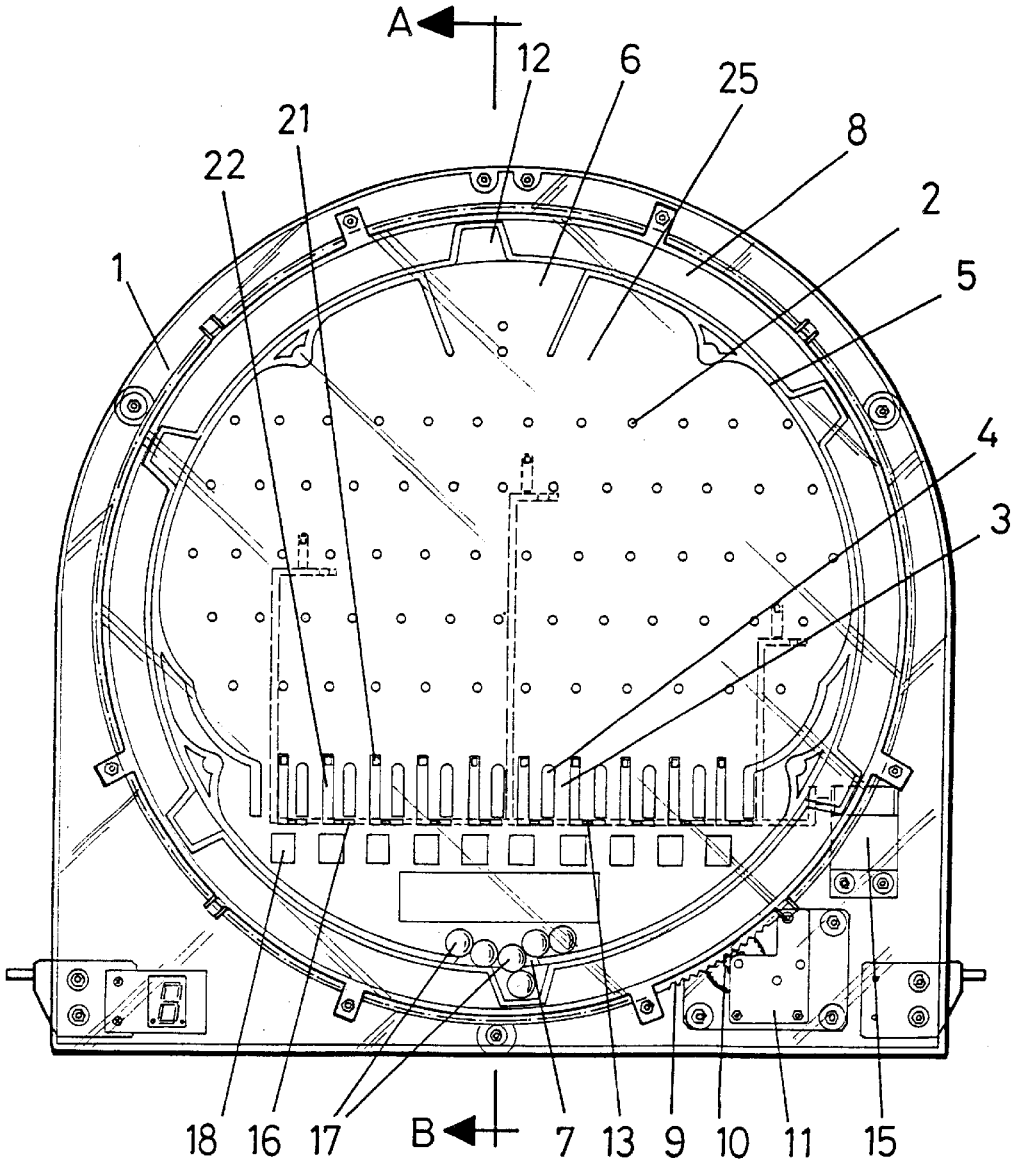
FIG. 1 shows a diagrammatic representation in front elevation of the game board of a labyrinth-type machine of chance equipped with the device for supplying/retaining/ checking balls which is the subject of the present invention.
Figure 2:
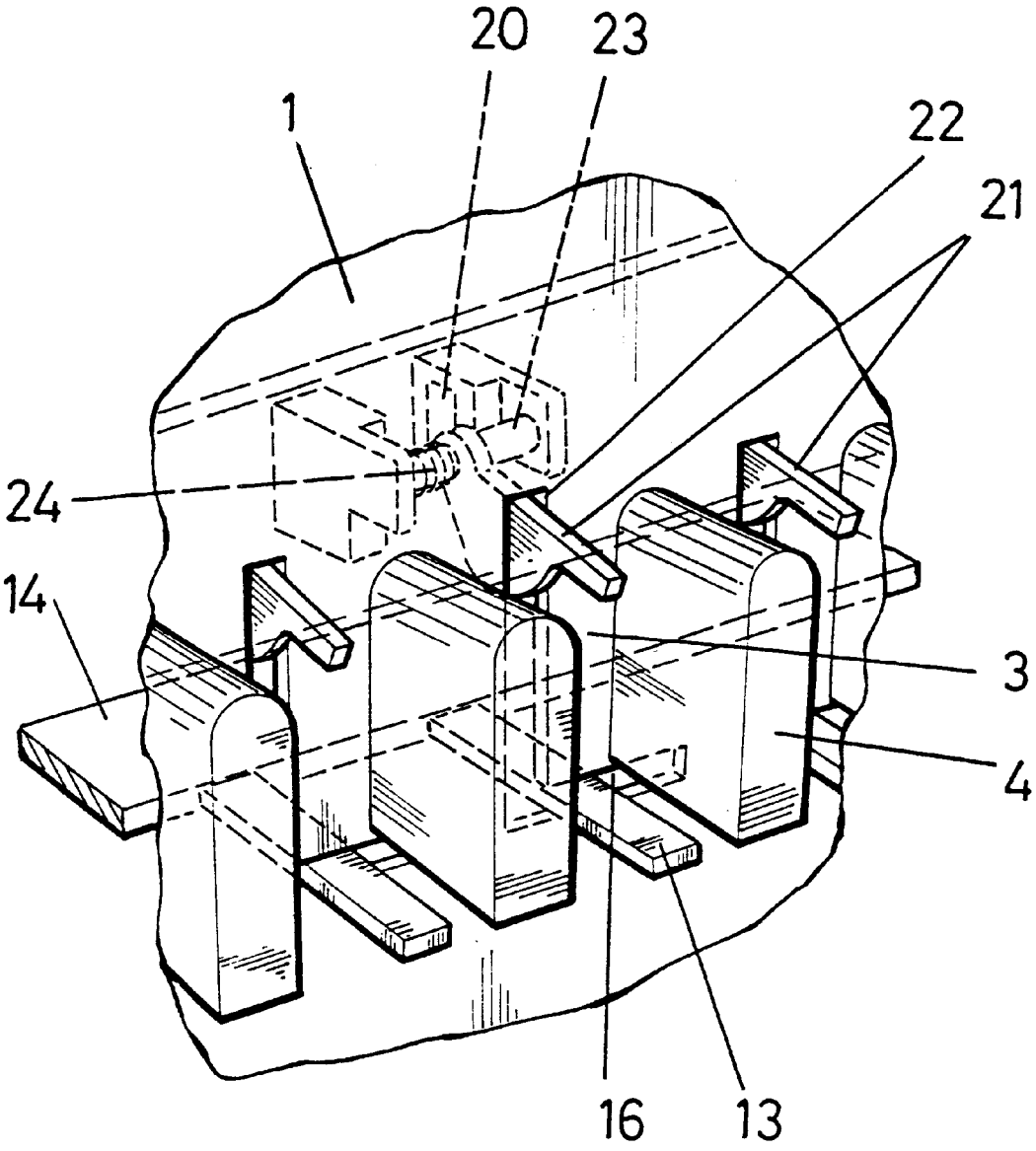
FIG. 2 shows, in perspective, an enlarged detail of the board of the previous figure, at the level of the exit passages for the balls.
Figure 3:
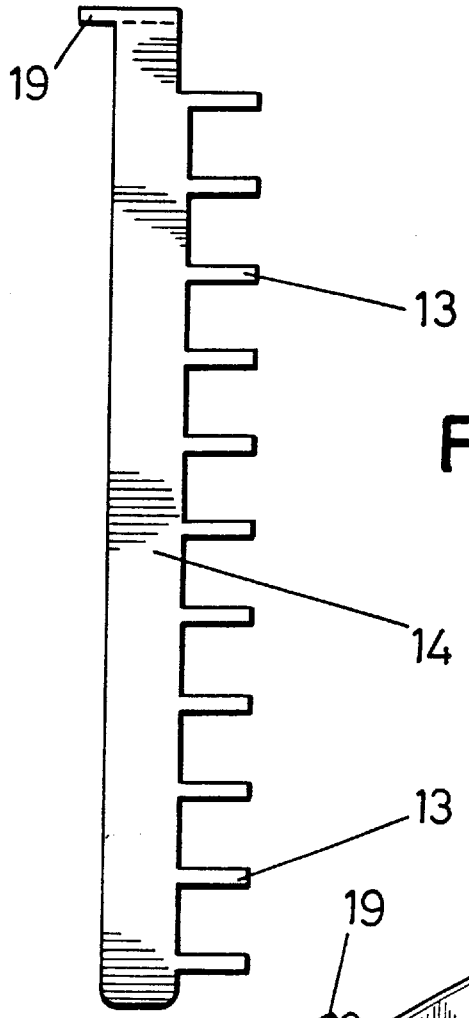
FIG. 3 shows a plan view of the retention comb provided for the case in which all the passages form a straight line.

When looking at these figures, it is possible to observe how the device which is advocated is intended to form part of a game in which there is a vertical board (1) provided with a plurality of pivots (2) which emerge perpendicularly from the front of the board defining labyrinth-type paths for one or more balls, in it or their vertical course under gravity, toward a series of passages (3), defined by small partitions (4), which are suitably distributed and spaced in keeping with the diameter of the balls.

Therefore, on the basis of this basic and conventional structure, the characteristics of the device of the invention center upon the fact that, on the front face of the board (1), and delimiting the game zone, there is a circumferential channel (5), with front opening, equipped in its inner wall with an upper opening (6) and another lower opening (7) for communication with the game zone of the board, a rotary ring (8) being installed within said circumferential channel (5) and being equipped with an outer toothing (9) for receiving the movement, via a gear (10), of a gear motor (11) which is responsible for supplying it with the necessary rotary movement, and said ring also incorporating one or more housings (12), which is or are open toward the inner partition of the circumferential channel (5), capable of being placed opposite the lower opening (7) in order to pick up a ball from the board, and the upper opening (6) in order to return said ball to the board after the ascending course determined by the rotary movement of the ring.

In accordance with the aforesaid, when, owing to the characteristics of the game, only one ball is involved in the device, the rotary ring (8) may incorporate a single lateral housing (12) so that, upon each complete rotation, it will supply said ball to the game board while, when, owing to the characteristics of the game, it is necessary for several balls to be involved, as shown in FIG. 1, there will also be a plurality of housings (12) in the ring (8) so that, upon each complete rotation of the ring, the number of balls required for the game in question is supplied to the game board (1).

For example, as shown in FIG. 1, the housings 12 are uniformly spaced at 60° intervals.

Moreover, in each passage (3) and, more specifically, in the lower zone thereof, there is a stop (13), the various stops (13) being joined together in a monobloc fashion, forming a type of comb (14) which is located behind the board (1), said stops (13) gaining access to the front face of the board via transverse grooves (16) which allow the necessary transverse displacement so that said stops (13) interrupt the passages (3) and therefore the path of the balls (17) or, rather, they are located beneath the partitions (4), leaving the passages (3) free and, consequently, allowing the balls to fall, which obviously takes place at the end of each play when the player has visually checked which passage or passages has or have been taken by the ball or balls (17) in its or their descending travel.

This transverse displacement of the comb (14) is effected with the collaboration of an electromagnet (15) which is suitably installed in the rear face of the board (1).

Depending on whether there is one or whether there are more balls (17) involved in the game, the device allows the player, upon each operating cycle of said device and in accordance with the established game program, to obtain scores or prizes corresponding to the passage or passages (3) taken by the ball or balls on its or their exit, it being possible for these scores or prizes to be fixed or variable and, in any case, being advised in a suitable manner to the player by means of displays (18) or of any other type of signaling device suitably placed opposite the respective passages (3), allowing, also, in the event of a plurality of balls (17) being involved in the game, combinations of passages to be established which award a prize.

Figure 4:
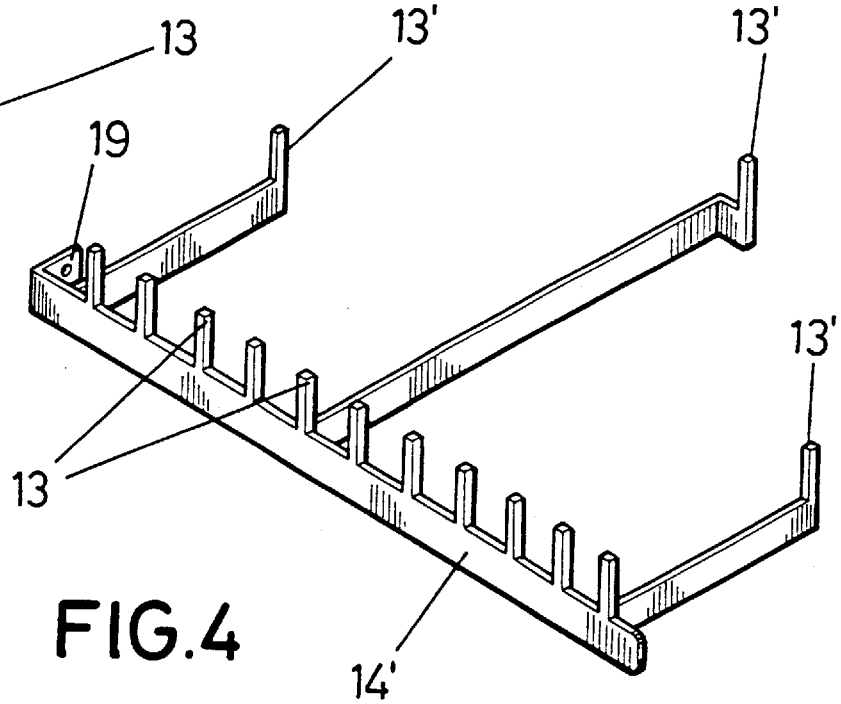
FIG. 4 shows a perspective view of another type of comb and corresponding to another type of arrangement of passages on the board, as shown in broken lines In FIG. 1.
Figure 5:
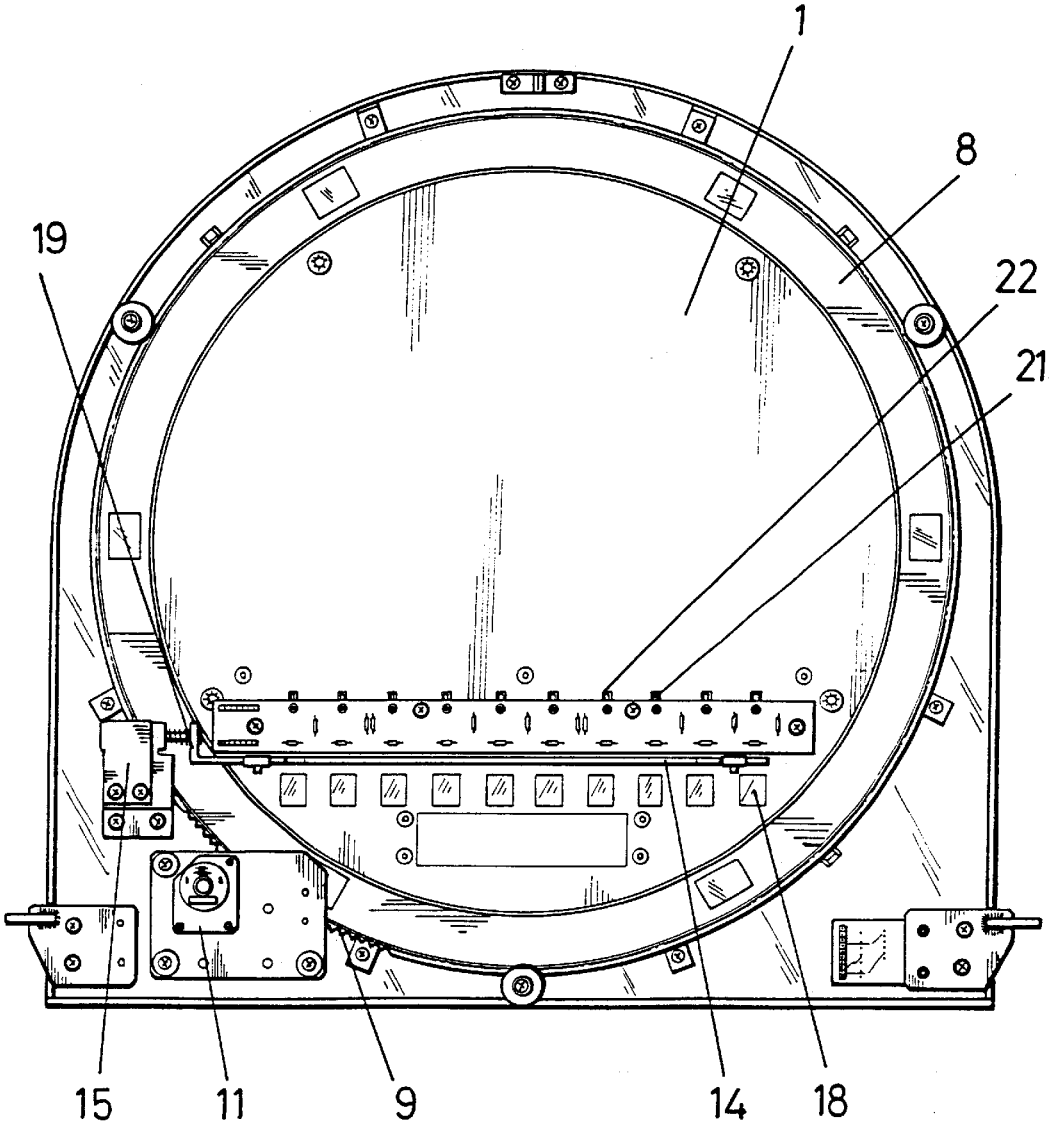
FIG. 5 shows a rear elevation of the assembly shown in FIG. 1.
Figure 6:
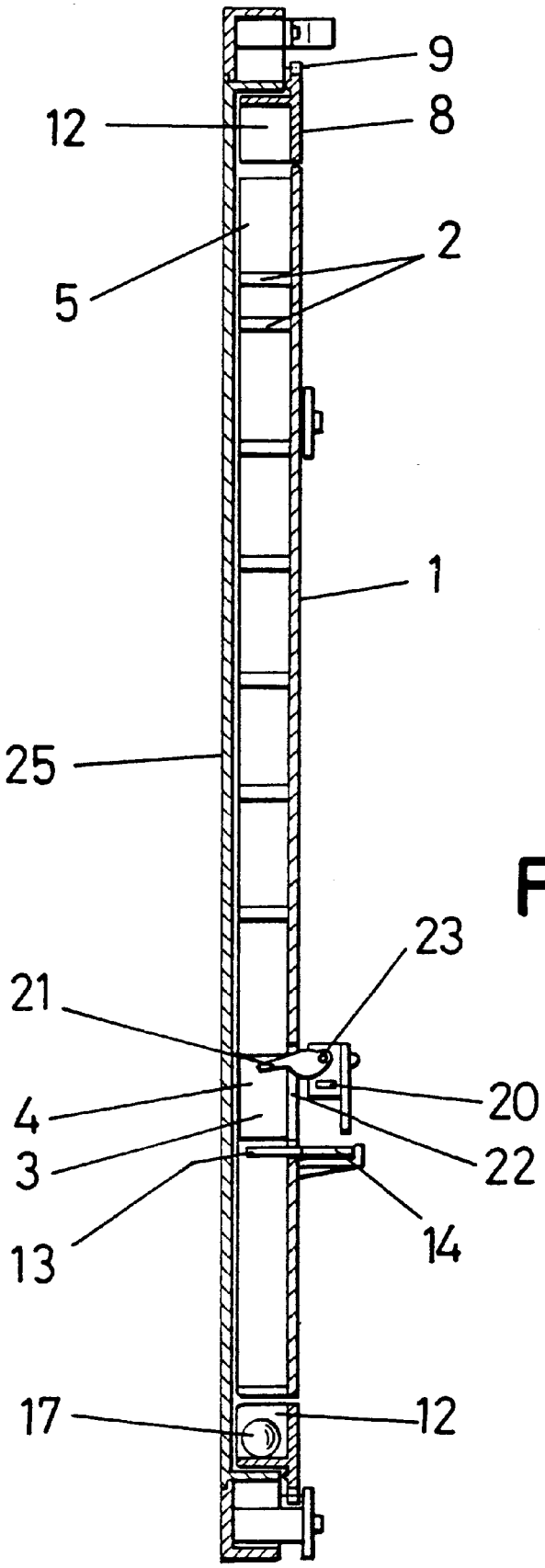
FIG. 6, finally, shows, in section, a detail in profile of the same assembly of the previous figure, along the sectional line A–B of FIG. 1.

These passages (3) for the path of the balls (17) may adopt a rectilinear, horizontal and lower position, as shown in unbroken lines in FIG. 1, or may adopt any other arrangement, in combination with or independently of the aforesaid, such as, for example, the arrangement shown in broken lines in said FIG. 1, in which case the retention comb will have to adopt the configuration shown in FIG. 4, where it appears with the reference number (14'), incorporating, as in the above case, a tab (19) at one of its ends for securing it to the movable core of the electromagnet (15).

This retention comb (14)–(14') makes it possible to hold the ball or balls (17) stable for a period of time which is more than sufficient for the player to be able clearly to observe which passage or passages has or have been taken by the ball or balls but, in parallel, the machine must also check said ball paths so that said paths affect the development of the game, especially in terms of the award of prizes.

To this end, provision has been made for the conventional use of sensors (20), based on a photoemitter/receiver, but with the special feature that said sensor is located behind the game board (1), where it is fully protected, beyond the reach of the balls, detecting the path of the balls together with a lever (21) which emerges toward the corresponding passage (3) from the front face of the board (1) via a vertical groove (22) and which is mounted so as to rock on a transverse spindle (23) and is assisted by a small spring (24), so that the ball (17) when it reaches one of the passages (3) causes the lever (21) to rock against the spring (24), said lever being that which interrupts the lightbeam of the sensor (20).

A transparent panel (25), for example made from methacrylate, is fitted to the game board, suitably distanced therefrom by the circumferential channel (5) itself, and it not only allows the surface of the game board (1) corresponding to the game zone but also the rotary ring (8) to be seen, so that the player is able to observe the ascending displacement of each ball, as stated above.

What is claimed is:

1. A device for supplying, retaining and checking balls for a labyrinth type game of chance comprising a board which, when held vertically has a top and a bottom;

a plurality of lugs projecting from the board and positioned to define labyrinth-type paths for the fall of balls under gravity along the board toward the bottom and into contact with and past the lugs;

a plurality of partitions positioned at the board toward the bottom, the partitions defining a plurality of passages for falling balls;

a circular circumferential channel around the board, the channel having a fixed radially inner wall with a top opening at the circumferential side of the channel at the top of the board and a bottom opening at the circumferential side of the channel at the bottom of the board providing communication through the openings between the channel and the board, with the top opening permitting balls to exit the channel and pass over the board and the bottom opening permitting balls to leave the board and enter the channel;

a rigid drive ring at the circumferential channel and a motor for cooperating with the drive ring for rotating the drive ring with respect to the channel;

the drive ring incorporating a housing, the housing opening radially inwardly and the housing being dimensioned for receiving a ball in the housing, such that rotation of the ring with its housing moves a ball from the entry into the channel at the bottom opening to the top opening where the ball may leave the housing through the top opening in the channel;

devices at the passages for contacting the balls and also for reading the positions of the balls in the passages.

2. The device of claim 1, wherein the housing is of a size to retain a single ball therein.

3. The device of claim 1, wherein the ring has a plurality of individual ball receiving housings therein each shaped and of a size to receive one ball and the housings being spaced at angular intervals apart sufficiently to feed one ball at a time to the top opening at spaced time intervals.

4. The device of claim 3, wherein the housings are spaced at intervals of 60° around the circumference of the ring.

5. A device for supplying, retaining and checking balls for a labyrinth type game of chance comprising a board which, when held vertically has a top and a bottom;

a plurality of lugs projecting from the board and positioned to define labyrinth-type paths for the fall of balls under gravity along the board toward the bottom and into contact with and past the lugs;

a plurality of partitions positioned at the board toward the bottom, the partitions defining a plurality of passages for falling balls;

a circular circumferential channel around the board, the channel having a radially inner wall with a top opening at the circumferential side of the channel at the top of the board and a bottom opening at the circumferential side of the channel at the bottom of the board providing communication through the openings between the channel and the board, with the top opening permitting balls to exit the channel and pass over the board and the bottom opening permitting balls to leave the board and enter the channel;

a driveable ring at the circumferential channel, the ring rotating with respect to the circumferential channel;

the ring incorporating a housing, the housing opening radially inwardly and the housing being dimensioned for receiving a ball in the housing, such that rotation of the ring with its housing moves a ball from the entry into the channel at the bottom opening to the top opening where the ball may leave the housing through the top opening in the channel;

devices at the passages for contacting the balls and also for reading the positions of the balls in the passages;

a respective stop at each of the passages for the balls and positioned to retain the balls within the passages;

a common support to which the stops are connected, and the stops being shaped and the support being shaped so as to define a comb style configuration with the stops defining the teeth of the comb;

the passages being arranged in a row and the comb being movable transversely, to simultaneously move all of the stops out of the passages, permitting the balls to then move through and out of the passages.

6. The device of claim 5, further comprising an electromagnet connected with the comb and the electromagnet is operable to a first condition for permitting the stops to block the passages and another position wherein the comb is moved to move the stops out of the passages.

7. The device of claim 5, further comprising a signaling element at each of the passages for displaying a prize or other characteristic corresponding to balls in each passage.

8. The device of claim 7, further comprising a sensor for electronic detection of the ball path behind the game board and associated with each of the passages; the sensor including a rocking lever emerging though the board to be contacted with a ball passing though the passage.

9. The device of claim 8, further comprising a rear spindle for each of the rocking levers, and each of the rocking levers being mounted to rock upon the rear spindle thereof; a spring acting against each of the levers permitting a ball to pass and also returning the lever to the operating position after the ball has passed, the lever being so positioned with respect to the sensor that the movement of the lever operates the sensor for detection of the ball path.

* * * * *